United States Patent [19]

Hill

[11] Patent Number: 4,964,926

[45] Date of Patent: Oct. 23, 1990

[54] FERRITIC STAINLESS STEEL

[75] Inventor: James B. Hill, Natrona Heights, Pa.

[73] Assignee: Allegheny Ludlum Corporation, Pittsburgh, Pa.

[21] Appl. No.: 284,888

[22] Filed: Dec. 15, 1988

Related U.S. Application Data

[62] Division of Ser. No. 94,461, Sep. 8, 1987, Pat. No. 4,834,808.

[51] Int. Cl.[5] ..... C22C 38/26; C22C 38/28

[52] U.S. Cl. ..... 148/325; 228/263.15; 420/42; 420/62; 420/70

[58] Field of Search ..... 148/325; 420/42, 62, 420/70; 228/263.15

[56] References Cited

U.S. PATENT DOCUMENTS

| | | | |
|---|---|---|---|
| 3,759,705 | 9/1973 | Chalk | 75/124 |
| 4,078,919 | 3/1978 | Kado et al. | 75/126 |
| 4,261,739 | 4/1981 | Douthett et al. | 75/126 |
| 4,417,921 | 11/1983 | Maurer | 75/128 |
| 4,608,099 | 8/1986 | Davison et al. | 148/325 |
| 4,640,722 | 2/1987 | Gorman | 148/325 |

FOREIGN PATENT DOCUMENTS

| | | | |
|---|---|---|---|
| 0048017 | 5/1978 | Japan | 148/325 |
| 0099025 | 8/1978 | Japan | 148/325 |

*Primary Examiner*—Upendra Roy
*Attorney, Agent, or Firm*—Patrick J. Viccaro

[57] ABSTRACT

A weldable ferritic stainless steel and a method for producing the same is provided wherein the steel consists essentially of up to 0.03 carbon, up to 0.05 nitrogen, 10 to 25 chromium, up to 1.0 manganese, up to 0.5 nickel, up to 1.0 silicon, 0.03 to 0.35 titanium, 0.10 to 1.0 niobium, optionally up to 1.2 aluminum, the balance essentially iron, the amounts of titanium and niobium varying inversely and not more than necessary to satisfy specific thermodynamic equations and the method includes casting the steel into ingots or slabs without the precipitation of detrimental intermetallic or nonmetallic titanium compounds so that the hot-rolled band gauge, without grinding, can be cold rolled to final gauge sheet or strip free of open surface defects.

12 Claims, 4 Drawing Sheets

ROLLING DIRECTION

FERRITIC STAINLESS STEEL

This is a division of application Ser. No. 094,461, filed Sept. 8, 1987, now U.S. Pat. No. 4,834,808.

BACKGROUND OF THE INVENTION

The present invention relates to substantially completely ferritic stainless steel having improved cold-rolled surface quality by substantially eliminating the formation and precipitation of oxides and titanium nitrides during casting. More particularly, the invention relates to ferritic stainless steel flat rolled products having good surface quality by stabilizing with controlled amounts of both titanium and niobium, and in some embodiments having improved elevated temperature oxidation resistance and strength compared to conventional type 409. Processing of the ferritic stainless steel is also provided.

Ferritic stainless steels have found increasing acceptance in automotive vehicle components such as exhaust systems, emission control systems and the like. Such end uses require steels having good high temperature strength and resistance against oxidation and corrosion. In comparison to austenitic stainless steels, ferritic stainless steels have inherent advantages for applications at elevated temperature. Particularly, ferritic stainless steels have a lower coefficient of thermal expansion, higher thermal conductivity and better resistance to oxidation during thermal cycling. When compared to austenitic steels, however, the ferritic stainless steels have certain disadvantages such as inferior strength at elevated temperature, welding and forming characteristics.

Steels for the automotive exhaust systems must meet certain specific requirements for mechanical properties, corrosion resistance, oxidation resistance, and elevated temperature strength as mentioned above. Extensive development work has gone into such alloys to meet these demands. A commonly used grade, type 409, is a chromium ferritic stainless steel having nominally 11% chromium and is stabilized with titanium. Such an alloy was developed in the 1960's, as disclosed in U.S. Pat. No. 3,250,611, issued May 10, 1966. Higher chromium steels such as on the order of 18% chromium are known to have greater oxidation and corrosion resistance and are also used for automotive exhaust systems. Today's exhaust system material requirements include higher temperature service, ability to be deformed severely, and better surface quality. In addition to hot strength and continuous and cyclic thermal oxidation resistance, such steels should have improved formability, such as for tubular manifolds, be weldable and be capable of being produced in thinner gauge.

It has been suggested by others in the art that additions of titanium, or niobium, or both can improve certain properties of ferritic stainless steels. U.S. Pat. No. 3,250,611, mentioned above, discloses a ferritic steel having 10 to 12.5% chromium and stabilized with 0.2 to 0.75% Titanium. The alloy was specifically developed for automotive exhaust systems and later became known as Type 409. Elongations of such T409 averaged about 24%, surface quality was poor, however, the alloy performed extremely well in mufflers and exhaust pipes.

Attempts have been made by others to improve the surface appearance and minimize roping by the addition of niobium to ferritic stainless steels. U.S. Pat. No. 3,936,323, issued February 3, 1976 and 3,997,373, issued Dec. 14, 1976 disclosed a steel having 12–14% chromium and from 0.2 to 1% niobium which is annealed and cold-rolled to a reduction of at least 65%. U.S. Pat. No. 4,374,683, issued Feb. 22, 1983, discloses a 12 to 25% chromium ferritic stainless steel containing copper and 0.2 to 2% niobium which when processed in a specific manner exhibits good surface appearance and good formability without roping.

It is also known, however, that niobium alone cannot be used as a stabilizer when the steel is to be fabricated to a welded product. Niobium contributes to weld cracking, however, it is known that adding at least 0.05% titanium in niobium stabilized ferritic stainless steels does substantially eliminate weld cracking.

Other ferritic stainless steels have been developed containing both titanium and niobium with or without other stabilizing elements. British Pat. No. 1,262,588 discloses such a steel for automotive exhaust components, wherein the chromium-titanium-aluminum steel contains at least 0.3% of titanium, zirconium, tantalum, and/or niobium for improved oxidation resistance at elevated temperatures. Another ferritic steel developed for improved creep resistance and oxidation resistance contains 0.1 to 1% niobium and titanium based on the amount of carbon and nitrogen up to an amount of 1% for a chromium-aluminum alloy disclosed in U.S. Pat. No. 4,261,739, issued Apr. 14, 1981.

U.S. Pat. No. 4,286,986, issued Sept. 1, 1981, discloses a process for producing a creep resistant ferritic stainless steel having a controlled chemistry including 0.63 to 1.15% effective niobium which may be replaced by tantalum. This steel is then annealed at a temperature of at least 1900° so as to improve creep strength.

Although it is generally known that titanium stabilized ferritic steels cannot be readily brazed with filler material such as oxygen free copper and nickel based alloys, a stabilized ferritic stainless steel composition which is wettable by conventional brazing materials is disclosed in U.S. Pat. No. 4,461,811, issued July 24, 1984, wherein the 10.5 to 13.5% chromium steel having up to 0.12% titanium, and up to 0.12% aluminum plus titanium is stabilized with titanium, tantalum and niobium in accordance with a stabilization formula.

It is known that the oxidation resistance of stainless steels can be improved as a result of the silicon content, as disclosed is an article in *Oxidation of Metals*, Volume 19, 1983, entitled "Influence of Silicon Additions on the Oxidation Resistance of a Stainless Steel" by Evans, et al. Such silicon containing stainless steels are known to be stabilized in order to improve certain properties. For example, U.S. Pat. No. 3,759,705, issued Sept. 18, 1973, discloses a 16 to 19% chromium alloy having 0.5 to 1.4% silicon, 1.6 to 2.7% aluminum, 0.15 to 1.25% niobium and 0.15 to 0.8% titanium. The alloy is said to have improved elevated temperature oxidation resistance and good cold formability.

U.S. Pat. No. 3,782,925, issued Jan. 1, 1974, discloses a 10 to 15% chromium ferritic stainless steel having small amounts of aluminum, silicon, titanium and one of the rare earth metals to provide a steel having improved oxidation resistance and an adherent oxide scale.

Another ferritic stainless steel having improved ductility and cold formability contains 13 to 14% chromium, 0.2 to 1% silicon, 0.1 to 0.3% aluminum and 0.05 to 0.15% titanium, as disclosed in U.S. Pat. No. 3,850,703, issued Nov. 26, 1974.

It is also known that niobium has a beneficial effect on the creep strength of ferritic stainless steels. An article entitled "Influence of Columbium on the 870° C. Creep Properties of 18% Chromium Ferritic Stainless Steels" by Johnson, SAE, February, 1981, discloses the improvement in such steels for automotive exhaust systems, particularly with the combination of approximately 0.5% free columbium (niobium) and a high final annealing temperature.

Attempts have been made to improve the weldability as well as the cyclic oxidation resistance and creep strength at elevated temperature for ferritic stainless steels. U.S. Pat. No. 4,640,722 issued Feb. 3, 1987 discloses a steel containing 1 to 2.5% silicon, greater than 0.1% niobium uncombined and up to 0.3% niobium combined and further stabilization with titanium, zirconium and/or tantalum in accordance with a stoichiometric equation.

Japanese Pat. No. 20,318 (published in 1977) discloses ferritic stainless steels containing titanium and niobium in amounts based on the carbon and nitrogen content of the steel as well as 0.5 to 1.5% silicon in a 4 to 10% chromium steel to improve weldability and cold workability.

Although Type 409 ferritic stainless steel has remained the preferred alloy of the automotive industry for exhaust systems and other high temperature service, the titanium and carbon levels have been reduced resulting in improved ductility and surface quality. In the 1980's the demand for manufacturing tubular exhaust components requires even lower carbon and titanium levels in an effort to further improve ductility, fabricability and weldability, however, such steels provide lower yield strengths, hardness and tensile strength. The automotive industry is further placing more stringent surface appearance requirements on such ferritic steels.

Titanium used to stabilize alloys such as Type 409, for fabricating automotive mufflers, pipes, manifolds, catalytic converters, has an extremely high affinity for nitrogen and oxygen and readily combines with these elements during melting, refining and casting to form and precipitate the nonmetallic oxides and intermetallic TiN. Such precipitates coalesce into large chunks or clusters and float to the surface of the cooling molten metal in the mold because they are less dense than the liquid metal. Upon freezing, the oxides and TiN clusters are trapped in or near the surface of the cast slabs. When this occurs, costly slab grinding and coil grinding is required to minimize rolling these clusters into detrimental and rejectable surface defects that reduce product yield and increase scrap and rework of the coils.

It has been suggested in the prior art that mechanical dams and filters may be used to trap intermetallic and nonmetallic compounds in molten steel. Such devices are costly, cumbersome and do not always work.

Additional processing steps such as slab grinding and coil grinding improve the surface condition but do not eliminate the so-called "open surface defect". Furthermore, the open surface defect worsens as the sheet or strip material is rolled to lighter gauges. An "open surface defect" appears as a gray or dark streak parallel to the rolling direction in the hot rolled band, which streak appears to have been rolled into the coil surface. The relative length and width of each defect in the hot rolled band is a good indication of the relative size of the clusters in the steel prior to rolling. Visual examination reveals numerous cross-breaks in the defect which indicate that the open surface defect is composed of material having a lower ductility than the steel matrix along with which it is rolled.

During casting into ingots, the stream from the ladle may react with air to form oxides and titanium nitride clusters that tend to concentrate near ingot surfaces. This condition, sometimes called "bark", is highly objectionable and must be removed by conditioning, such as grinding, to produce a saleable product.

There still exists a need for a ferritic stainless steel alloy suitable for high temperature service which does not exhibit the open surface defects of titanium-bearing stainless steels. Such steels should be capable of being produced in light gages on the order of less than 0.015 inch without surface defects or holes. The steel and the method of producing the same should substantially eliminate the formation of intermetallic and nonmetallic titanium precipitates at or near the surface of ingots or continuously cast slabs in order to provide a cold-rolled sheet or strip product which is substantially free of the open surface defect. Furthermore, such ferritic stainless steel should be able to be produced by lower cost processes which eliminate the need for additional slab or coil grinding procedures and which permit rolling to thinner gauges as a result of eliminating the formation of the titanium nitride precipitates. Any alloy produced should be at least comparable to the Type 409 alloy in use in the automotive exhaust systems in terms of fabricability, and oxidation and corrosion resistance.

SUMMARY OF THE INVENTION

A method of producing a weldable ferritic stainless steel sheet or strip product having improved surface quality is provided. The method includes preparing a steel melt containing by weight percent, up to 0.03 carbon, up to 0.05 nitrogen, 10 to 25 chromium, up to 1.0 manganese, up to 0.5 nickel, up to 1.0 silicon, 0.03 to 0.35 titanium, 0.10 to 1.0 niobium, optionally up to 1.2 aluminum, and the balance of essentially iron. The titanium and nitrogen are present in inverse amounts which are not more than necessary to satisfy specific thermodynamic equations. The method further includes casting the steel into ingots or slabs without the formation of detrimental intermetallic or nonmetallic titanium compounds, working the steel slab by hot rolling and cold rolling to final gauge strip or sheet of improved surface quality without grinding the slab, strip, or sheet for removal of surface defects attributable to titanium nitride. The method includes maintaining the solubility products of titanium compounds below the saturation level at the liquidus temperature. The steel can be economically produced in cold rolled final gauge of less than 0.015 inch and may be brazeable.

DETAILED DESCRIPTION OF THE PREFERRED EMBODIMENTS

Figure 1A:
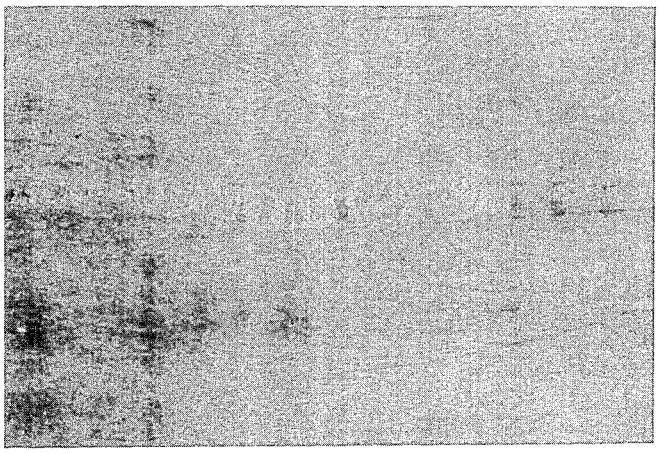
FIG. 1A is a photograph of Type 409 hot rolled band showing the "open surface defect".
Figure 1B:
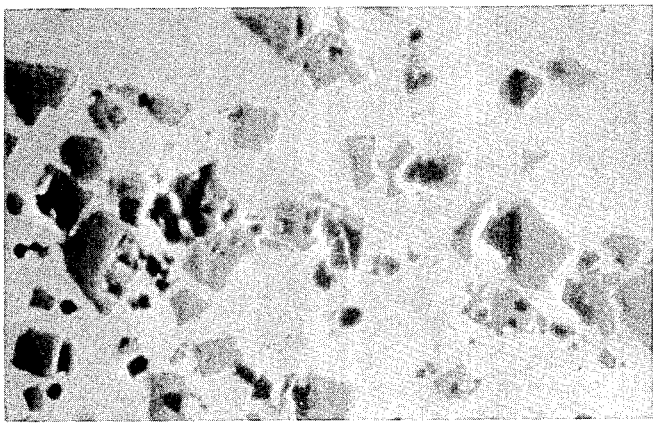
FIG. 1B is a Scanning Electron Microscope (SEM) micrograph of the "open surface defect" of FIG. 1A showing a TiN cluster at 1833X.
Figure 1C:
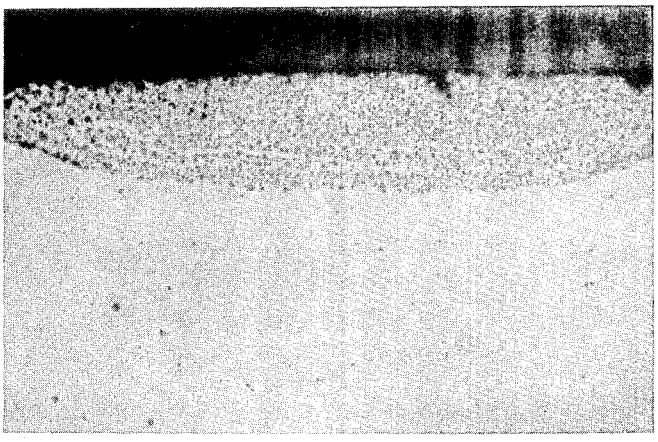
FIG. 1C is an optical micrograph of an open surface defect shown in cross-section perpendicular to the rolling direction.

In general, there is provided a ferritic iron chromium alloy stabilized with both titanium and niobium which is weldable, has improved surface quality despite the presence of titanium, and exhibits in preferred embodiments improved elevated temperature oxidation resistance and strength. Also broadly, a method is provided for preparing such a steel melt, casting the steel into slabs or ingots without the precipitation of detrimental amounts of intermetallic or nonmetallic titanium compounds. This allows working the steel to final gauge strip or sheet without grinding for removal of melting related open surface defects attributable to the titanium compounds. FIGS. 1A, 1B, and 1C illustrate the open surface defect of the prior art on Type 409 hot rolled band.

As used herein, all composition percentages are in weight percent.

The chromium level may range from 10 to 25%, in order to provide the desired properties such as corrosion and oxidation resistance. The upper level of chromium is limited to avoid unnecessary hardness and strength which would interfere with the formability of the alloy. Chromium levels less than 10% tend to provide inadequate oxidation and corrosion resistance. Chromium content of 10 to 12% and 16 to 19% are preferred ranges.

The silicon content may range up to 1% with a preferred minimum of at least 0.5%. Silicon is an element commonly used for deoxidation in the production of steel and provides for general oxidation resistance and aids in fluidity of the molten alloy and thus aids in welding. In the present invention at least 0.5% silicon has been found to enhance continuous and cyclic oxidation resistance. Preferably the silicon content is kept below 0.7% because silicon decreases ductility of the alloy.

In accordance with the present invention, it has been found that the open surface defect in ferritic stainless steels, such as Type 409, can be substantially eliminated by avoiding the precipitation of oxides and titanium nitrides during melting, refining and casting. One such way is to achieve stabilization with titanium but that would necessitate refining the steel to very low carbon and nitrogen levels by expensive melting and refining practices.

In accordance with the present invention, the titanium content of the ferritic stainless steel is kept below the solubility limit of the metallic and nonmetallic titanium compounds in the molten metal. The precipitation of the compounds which are responsible for the objectionable open surface defect prior to the solidification is prevented. Thus the open surface defect which is revealed in the processing of titanium stabilized ferritic stainless alloys is prevented. Using specified amounts of niobium and titanium as determined by alloy composition controls the formation of the detrimental titanium compound precipitates to a maximum non-critical level in order to result in a final cold rolled sheet or strip in coil form that is substantially free of the open surface defect.

If the solubility product of titanium compounds is maintained below the saturation level at the liquidus temperature, the titanium compound is unstable and will not precipitate prior to freezing of the metal. Prior practices have attempted this by minimizing the nitrogen content of the steel, and minimizing the use of nitrogen during refining and minimizing exposure of the molten metal to nitrogen diffusion from the atmosphere such as during pouring from the vessel to a ladle. Current analysis requirements and normal argon-oxygen-decarburization (AOD) practice do not allow cost effective reduction of nitrogen content to levels low enough to prevent precipitation of the objectionable titanium compounds. The present claimed invention solves the problem by minimizing the titanium content whereby the titanium nitride is soluble down to the liquidus temperature within the normal nitrogen content range. Such is accomplished by replacing the reduced titanium content with sufficient niobium. As used herein, stabilization is accomplished with Ti and Nb by combining with carbon and nitrogen to avoid adverse effects upon intergranular corrosion resistance.

The steel is stabilized with titanium and niobium in controlled amounts. Titanium is present in amounts of 0.03 up to 0.35% maximum, preferably 0.05 up to 0.15% and more preferably 0.05 up to 0.1%. The amount of titanium, and its relation to nitrogen content is further described below with respect to specified thermodynamic equations. For brazeability, Ti should range only up to 0.12 in relation to the aluminum content.

Niobium is present from 0.1% up to 1.0%. To provide lower cost alloys within the invention, Nb should be kept as low as possible within the range, but for those embodiments requiring higher elevated temperature strength, higher amounts of Nb within the range and on the order of about 0.6% or more may be used.

It is desirable to keep normal steelmaking impurities at relatively low levels. The alloy in the present invention does not require special raw materials selection to maintain such impurities at extremely low levels. The alloy of the present invention can be satisfactorily made by using electric arc furnaces or AOD (argon-oxygen-decarburization) processes.

Methods for reducing carbon and nitrogen contents are well known and such methods are applicable to the present invention. The carbon levels may range up to 0.03% and, preferably up to 0.01% with a practical lower limit being 0.001%. Nitrogen may range up to 0.05% and, preferably up to 0.03% with a practical lower limit being 0.003%. The amount of nitrogen that may be tolerated is affected by the titanium content as described below.

Broadly, the alloy of the present invention comprises up to 0.03 carbon, up to 0.05 nitrogen, 10 to 25 chromium, up to 1.0 manganese, up to 0.5 nickel, up to 1.0 silicon, 0.03 to 0.35 titanium, 0.10 to 1.0 niobium, optionally up to 1.2 aluminum, and the balance iron and incidental impurities. A preferred embodiment of the alloy includes up to 0.03 carbon, up to 0.05 nitrogen, 10–13 chromium, up to 1.0 manganese, up to 0.5 nickel, 0.5 to 0.7 silicon, 0.03 to 0.10 titanium, 0.1 to 1.0 niobium, optionally up to 1.2 aluminum, and the balance iron. Another preferred embodiment of the alloy includes up to 0.03 carbon, up to 0.05 nitrogen, 16–19 chromium, up to 1.0 manganese, up to 0.5 nickel, 0.5 to 1.0 silicon, 0.03 to 0.1 titanium, 0.1 to 1.0 niobium, optionally up to 1.2 aluminum, and the balance iron. For all of these embodiments, the titanium and nitrogen contents will be present within the ranges in inverse amounts which are not more than that necessary to satisfy the thermodynamic equations described below. Calculations performed using thermodynamic equilibrium equations for a given steel melt composition illustrate the findings of the present invention. For a given steel melt composition, having a known liquidus and solidus temperature, the basic thermodynamic equations for determining the solubility of TiN are:

$$6.194 - \frac{16437}{T} = \log \%N + \log \%Ti + \log f_N + \log f_{Ti} \quad \text{Eqn. 1}$$

Where $$\log f_N = \left(-\frac{164}{T} + 0.0415\right)\%Cr + \left(\frac{8.33}{T} + 0.0019\right)\%Ni - 0.53\%Ti + \left(-\frac{134}{T} + 0.035\right)\%Mn + 0.103\%C - 0.067\%Nb + 0.05\%Si + \left(\frac{744}{T} - 0.421\right)\%Al + \tfrac{1}{2}\left\{\left(\frac{3.35}{T} - 0.0012\right)(\%Cr)^2 + \left(-\frac{3.67}{T} + 0.0021\right)(\%Ni)^2 + \left(\frac{17.6}{T} - 0.011\right)(\%Mn)^2\right\} + \left(\frac{1.6}{T} - 0.0009\right)(\%Cr)(\%Ni) + \left(\frac{2.16}{T} - 0.0005\right)(\%Cr)(\%Mn) + \left(\frac{0.09}{T} + 0.0007\right)(\%Ni)(\%Mn) \quad \text{Eqn. 2}$$

and $$\log f_{Ti} = 0.053\%Ti - 1.81\%N + 0.022\%Cr + 0.009\%Ni + \tfrac{1}{2} - 0.0002\,(\%Cr)^2 + 0.001\,(\%Ni)^2 - 0.0006\,(\%Cr)(\%N) \quad \text{Eqn. 3}$$

for $T$ = temperature of alloy in degrees Kelvin

At any given temperature, T and alloy composition from the above given equations the percentage of N that would lead to TiN precipitation is calculated. If the percentage of N is maintained below the calculated value, then TiN will not precipitate. Conversely for any given composition from the above equations, the percentage of Ti which will lead to TiN precipitation can be calculated. The percentage of Ti should then be maintained below the calculated value to avoid TiN precipitation.

Figure 2:
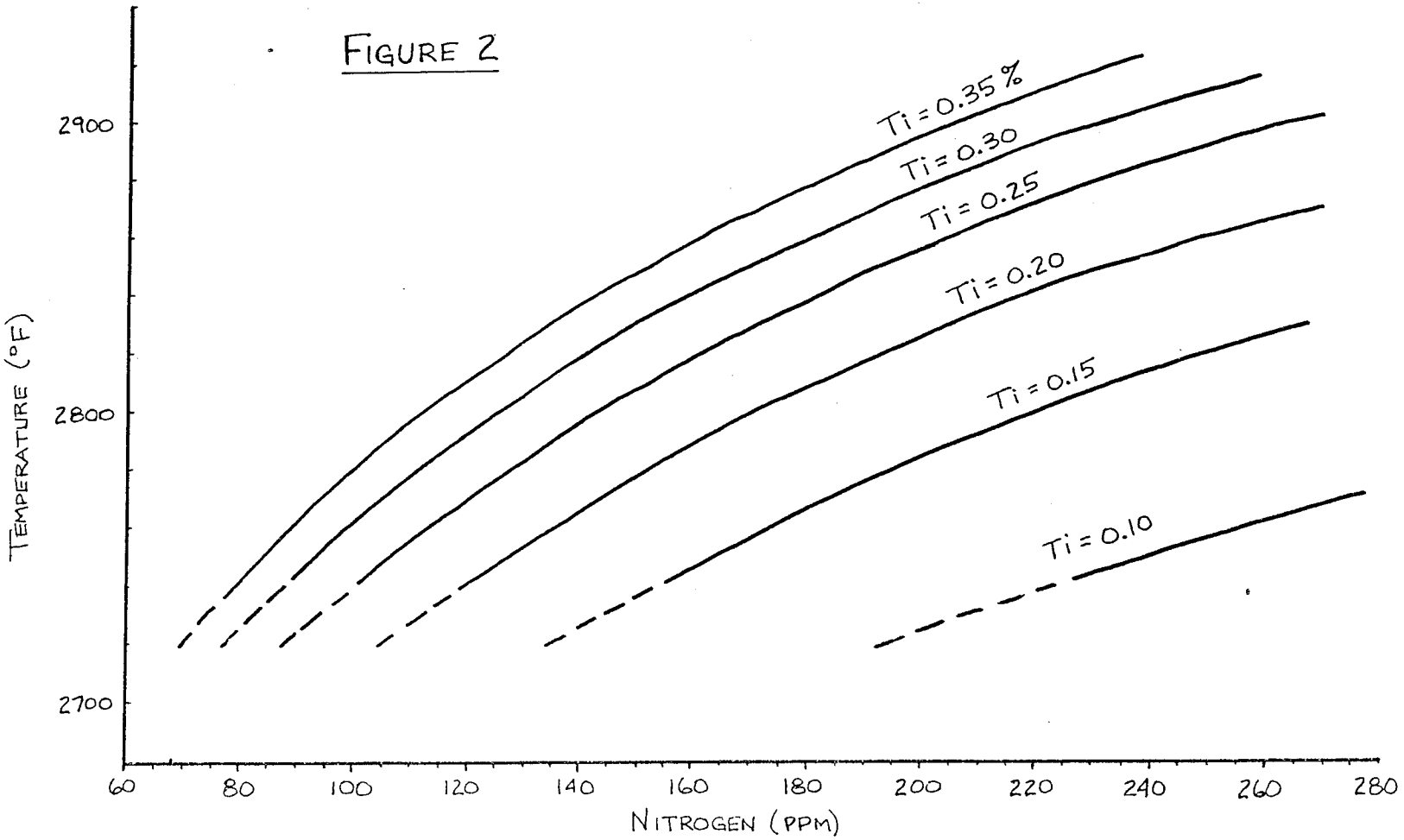
FIG. 2 is a plot of nitrogen content and liquidus temperature for a nominally 11.5% chromium steel illustrating TiN solubility at various titanium levels.

FIG. 2 illustrates the solubility of TiN in a steel generally having 11.5 Cr, 0.01 C, 0.35 Mn, 0.25 Ni, 0.3 Si, 0.25 Nb, balance Fe for a range of titanium and nitrogen levels. Calculations have been performed for the composition range having 0.05 to 0.5% titanium and from 0 up to 0.5% niobium. The solubility of TiN in an alloy containing nominally 11.5% chromium and 0.25% niobium illustrates that at the liquidus temperature of about 2745° F. (1507° C.), an alloy containing 0.1% titanium can tolerate contents up to 0.023% nitrogen before precipitating any titanium nitrides. Such an alloy containing 0.15% titanium can tolerate nitrogen up to about 0.016% only. Such calculations further show that such an alloy containing 0.35% titanium requires nitrogen contents lower than 0.008% in order to avoid titanium nitride precipitation. Such lower nitrogen levels would be very costly to obtain in the conventional melting processes. In the AOD process, typical nitrogen levels in the ladle after argon bubbling may range from 0.012% to 0.02% nitrogen depending on argon usage during the AOD refining.

As is known, the liquidus and solidus temperature are a function of the composition of the steel and thus varies. For example, the above mentioned 11.5% chromium alloy has a liquidus temperature of about 2745° F., while a similar alloy with 18% chromium has a liquidus temperature of about 2720° F. (1493° C.).

Figure 3:
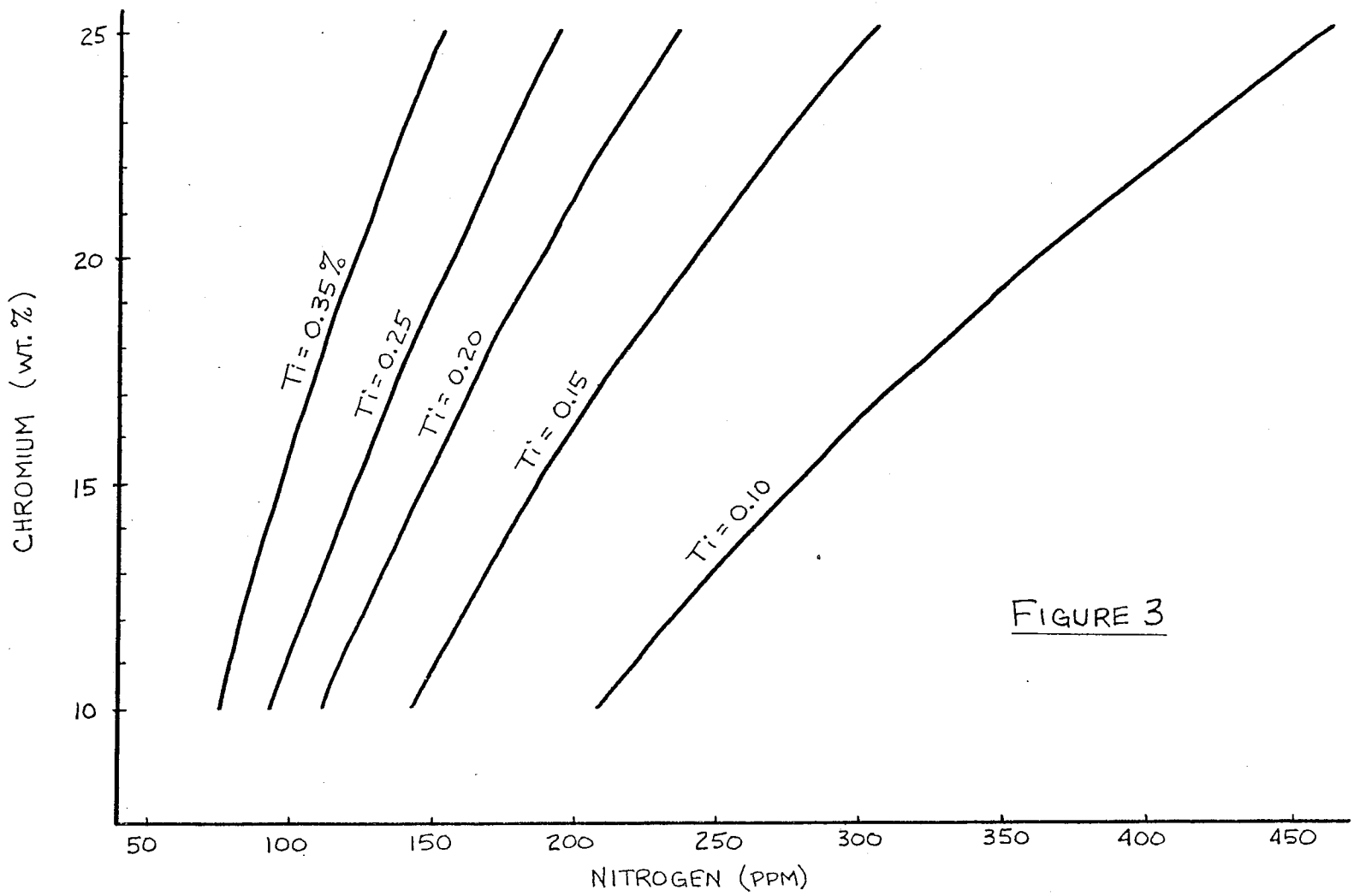
FIG. 3 is a plot of nitrogen content and chromium content illustrating TiN solubility at various titanium levels.

FIG. 3 illustrates the solubility limits of TiN as a function of chromium and nitrogen contents for an alloy containing 0.01% carbon, 0.35% manganese, 0.25% nickel, 0.30% silicon and 0.25% niobium for various titanium levels.

Figure 4:
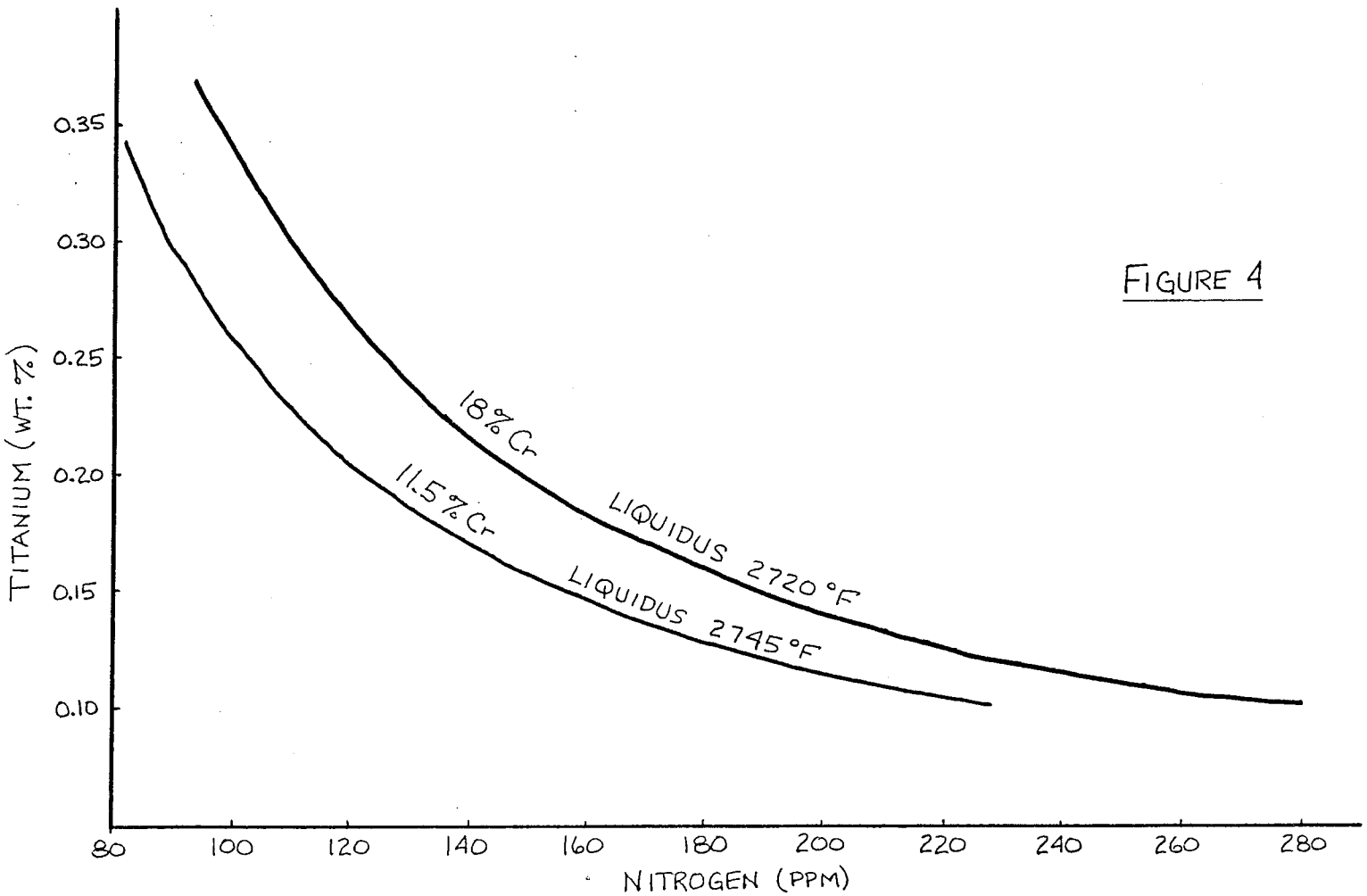
FIG. 4 is a plot of nitrogen content and titanium content illustrating TiN solubility for the liquidus temperature for nominally 11.5% and 18% Cr steels.

FIG. 4 illustrates the solubility limits of TiN as a function of titanium and nitrogen contents for nominally 11.5 and 18.5% chromium alloys at the respective liquidus temperatures.

Such figures which were developed from the thermodynamic equations show that the presence of nitrogen and titanium will vary inversely and should not be present in amounts more than necessary to satisfy Equation 1 above in order to cast and solidify the steel without the precipitation of detrimental intermetallic or nonmetallic titanium nitride. The result is a steel strip or sheet which does not require grinding and which exhibits improved cold rolled surface quality substantially free of open surface defects.

Methods for reducing oxygen and sulfur content are also well known and such conventional methods are applicable to the present invention. Oxygen content may range up to 0.05% and preferably, up to 0.01% with a practical lower limit being 0.001%. Sulfur levels may range up to 0.03%, preferably up to 0.02% with a practical lower limit being 0.0005%. Another normal steelmaking impurity is phosphorus which may be present up to 0.04% and preferably up to 0.025% with a practical lower limit being about 0.01%.

Nickel and copper are two other normal steelmaking impurities. Nickel should be less than 0.5% and preferably less than 0.25%, the practical lower limit being 0.01%. Copper should also be maintained at a level of less than 0.3% and, preferably, less than 0.2% with a practical lower limit being about 0.01%. To provide for copper and nickel contents of less than the lower limit would have no effect on the ordered properties, but would be difficult to achieve without specific raw material selection.

Manganese levels may range up to 1% and, preferably, up to about 0.55% with the lower limit being about 0.06%.

Optionally the aluminum content of the alloy may range up to 1.2%. Higher aluminum content within the range of the alloy will enhance the oxidation resistance at elevated temperature. For optimum weldability and brazeability, the aluminum content may range from 0.01 to 0.07%. For improved wetting during brazing, the steel may have up to 0.1 aluminum, up to 0.12 titanium, and up to 0.12 aluminum plus titanium. Aluminum in some minor amounts is usually present because it is also a conventionally used deoxidizing agent during melting and refining and, when used only for this purpose should be kept below 0.1%.

In order to more completely understand the present invention, a mill experiment was conducted wherein two mill heats were melted as described in the following examples:

EXAMPLE I

An alloy of the present invention was prepared by melting a mill heat of suitable materials to produce a melt of the following composition:

| C | P | S | Mn | Si | Cr | Ni | Al | Mo | Cu | N | Ti | Nb |
|---|---|---|---|---|---|---|---|---|---|---|---|---|
| .007 | .017 | .001 | .45 | .57 | 10.95 | .16 | .02 | .04 | .10 | .017 | .098 | .28 |

The melt was refined in an AOD vessel and then continuously cast into slabs which were ground to remove mill scale. The method of melting and refining included maintaining the solubility products of titanium compounds below the saturation levels at the liquidus temperature of the steel melt. Some of the slabs were hot rolled to band gauge of 0.155 inch and the other slabs were hot rolled to band gauge of 0.090 inch.

Four coils were then cold rolled in a conventional manner from the 0.090 inch hot rolled band (HRB) to a cold rolled final gauge of about 0.018 inch. The HRB exhibited excellent surfaces with no open surface defects. The HRB were then cold rolled without coil grinding. The cold rolled steel was then subjected to conventional annealing and pickling operation. Material from these coils was evaluated for fabricability and weldability as muffler wrap stock. The surface appearance of all four coils was excellent and free of open surface defects or any melting related defects. Because of the excellent surface appearance, no grinding was necessary for the sheet product in HRB coil form.

One coil was cold rolled in a conventional manner from 0.090 inch HRB to a thinner gauge, particularly 0.011 inch, and then subsequently annealed and pickled in a conventional manner. The surface condition of the HRB coil was excellent and free from any open surface defects or melting related defects. The HRB coil did not have to be ground to remove any melting related defects to improve the cold rolled surface quality. Such thinner gauge cold rolled sheet was then evaluated for its suitability for welding and fabricating into exhaust gas recirculation tubes for automotive applications. The surface appearance was exceptionally free of defects and the material formed and welded well.

Two additional coils were cold rolled from a hot rolled band gauge of 0.155 inch to a cold-rolled final gauge of 0.058 inch and subsequently annealed and pickled. These coils were evaluated for mechanical properties.

The mechanical properties were obtained on two coils of the heat having a chemistry of the present invention. The mechanical properties are shown in the following Table for four samples, two from each coil, from ends (a) and (b). Also shown are typical Type 409 mechanical properties at nominally 0.058 inch gauge.

| Coil # | Yield Strength KSI | Tensile Strength KSI | Elong. % in 2 in. | Rb |
|---|---|---|---|---|
| 029 (a) | 36.8 | 62.5 | 38 | 72 |
| 029 (b) | 36.0 | 61.5 | 37 | 71 |
| 030 (a) | 37.4 | 63.5 | 37 | 72 |
| 030 (b) | 37.1 | 62.0 | 39 | 72 |
| T409 | 40.0 | 65.0 | 32 | 74 |

The alloy of the present invention has adequate mechanical properties comparable to Type 409 alloy and exhibits improved ductility.

The corrosion resistance of the alloy of the present invention of this example was also evaluated and compared with Type 409 and modified T409 steels in various corroding media. Particularly the alloy was tested in accordance with a ASTM 763 Practice Z, in 10% ASTM water and in Walker synthetic condensate. The steel was also tested in boiling 20% H3PO4 and at room temperature for 5% HNO3 and 15% HN03.

The following steel compositions were tested and compared with the Example I alloy of the present invention. Steel A is type 409 steel and Steel B is a modified T409 Steel.

| Steel | C | P | S | Mn | Si | Cr | Ni | Al | Mo | Cu | N | Ti | Nb |
|---|---|---|---|---|---|---|---|---|---|---|---|---|---|
| A | .016 | .03 | .001 | .43 | .41 | 11.38 | .24 | .036 | .07 | .25 | .014 | .30 | .006 |
| B | .010 | .020 | .002 | .45 | .49 | 11 | .12 | .038 | .03 | .09 | .013 | .32 | .002 |

The results appear in the following table for the base metal and welded conditions showing corrosion rate in inches per month:

| Steel | Condition | ASTM 763 Practice Z | 10% ASTM Water | 20% H3Po4 Boiling | 5% HNO3 Rm. Temp | 15% HNO3 Rm. Temp |
|---|---|---|---|---|---|---|
| A | Base | 0.0205 | — | 0.0003 | 0.0009 | 0.0003 |
| | Welded | 0.5318 | 0.0000 | 0.0003 | 0.0006 | 0.0003 |
| B | Base | 3.0052 | — | 0.0049 | 0.0011 | 0.0005 |
| | Welded | 2.1963 | 0.0000 | 0.0029 | 0.0007 | 0.0005 |
| Ex. I | Base | 0.4859 | — | 0.0034 | 0.0028 | 0.0009 |
| | Welded | 0.5798 | 0.0000 | 0.0022 | 0.0023 | 0.0011 |

The corrosion resistance of the alloy of the present invention is comparable to commercial T409 chemistries. Variations in corrosion rates shown in the table are typical of the variability of rates found in corrosion testing.

Samples from the Example I heat were also evaluated for both continuous oxidation resistance and resistance to oxidation during thermal cycling in comparison to Type 409 and modified 409 steels. Samples were tested by subjecting the samples to 100 hours at 1600° F. (871° C.) in a still air oxidizing environment at 33° F. to 43° F. dewpoint to determine the total weight gain (mg/cm2).

The tests were conducted with the steel of the present invention of Example I, with Type 409 Steel C, and the modified T409 steel D having the following compositions:

| | C | P | S | Mn | Si | Cr | Ni | Al | Mo | Cu | N | Ti | Nb |
|---|---|---|---|---|---|---|---|---|---|---|---|---|---|
| C | .009 | .023 | .002 | .25 | .31 | 11.38 | .31 | .047 | .04 | .13 | .015 | .35 | .001 |
| D | .008 | .024 | .001 | .44 | .52 | 10.96 | .16 | .065 | .03 | .13 | .012 | .26 | .001 |

The results appear in the following table:

| Steel | Weight Gain in 100 Hrs @ 1600 Degrees F. (mg/cm2) |
|---|---|
| C | 71.4 |
| D | 0.6 |
| Ex. I | 0.5 |

It was generally considered that a weight gain of 1.5 mg/cm2 or more would be unacceptable for high temperature service, such as automotive exhaust components. The Type 409 steel (Steel C) had a weight gain of 71.4 mg/cm 2, while the alloy of the present invention had a weight gain of only 0.5 mg/cm2. Type 409 steel appears to have a maximum continuous 100 hour temperature limit of below 1600° F. (816° C.). The steel of the present invention easily meets the 1.5 mg/cm2 criteria at 1600° F. (871° C.) for 100 hours.

Cyclic thermal oxidation resistance was also evaluated in an ASTM wire life tester generally in accordance with the procedure outlined in Specification B 78-59T. The cyclic test includes repetitively resistance heating 0.0020" (0.051 mm) thick×0.250" (6.35 mm) wide strip to temperature for 2 minutes and then cooling to room temperature for 2 minutes. Failure occurs when the strip oxidizes through and breaks. Tests at different temperatures allow a curve of cycles to failure vs. test temperature to be drawn. From this curve for each alloy the temperature for failure at 2000 cycles is taken to describe the thermal cyclic oxidation resistance of the alloy.

Cyclic thermal oxidation tests were conducted with the steel of the present invention of Example 1, with the modified T409 Steel D, and with T409 Steel E having the following composition:

| | C | P | S | Mn | Si | Cr | Ni | Al | Mo | Cu | N | Ti | Nb |
|---|---|---|---|---|---|---|---|---|---|---|---|---|---|
| E | .007 | .025 | .002 | .39 | .37 | 11.23 | .16 | .037 | .033 | .14 | .012 | .35 | .001 |

The temperature indicated for failure in 2000 cycles by each composition is shown in the following table:

| Steel | Temperature (Degrees F.) for Failure in 2000 Cycles |
|---|---|
| E | 1470 |
| D | 1548 |
| Ex. 1 | 1595 |

The results of both the continuous and cyclic oxidation resistance tests show similar properties for the modified T409 Steel D and Example I steels which were tested. It is believed that this is generally attributed to the silicon levels of about 0.5 which is slightly higher than typical levels of about 0.34 in Type 409 steels. Another reason may be a contribution of Nb to protective scale adherence and thus improvement in thermal cyclic oxidation resistance of the steel of Example 1. In one embodiment of the present invention, the steel includes sufficient Si and Nb to exhibit such improved oxidation resistance.

The continuous and cyclic oxidation resistance tests demonstrate that the alloy of the present invention has improved oxidation resistance and may provide a useful temperature of 100° F. or more above that of Type 409 steel.

EXAMPLE II

Another alloy of the present invention was prepared by melting a mill heat of suitable materials to produce a melt of the following composition:

| C | P | S | Mn | Si | Cr | Ni | Al | Mo | Cu | N | Ti | Nb |
|---|---|---|---|---|---|---|---|---|---|---|---|---|
| .007 | .027 | .001 | .46 | .49 | 10.91 | .27 | .03 | .05 | .15 | .018 | .10 | .18 |

This melt was refined in a similar manner as in Example I. None of the slabs exhibited melting related defects of titanium oxide or titanium nitride precipitates near the slab surfaces. Some of the slabs were hot rolled to band gauge of 0.260 inch, other slabs to 0.155 inch HRB and other slabs to 0.090 inch HRB.

One coil was cold rolled in a conventional manner from 0.260 inch HRB to a final gauge of 0.131 inch, then subjected to a conventional anneal and pickle. No melting related defects in the HRB were observed The final gauge strip had excellent surface appearance free of open surface defects.

Another coil was cold rolled from 0.155 inch HRB to 0.032 inch, then subjected to a conventional anneal and pickle. The HRB coil was not ground before cold rolling to final gauge strip which was free of open surface defects.

The mechanical properties were obtained from both ends (a) and (b) of one coil with the following results:

| Coil # | Gauge (inch) | Yield Strength KSI | Tensile Strength KSI | Elongation (% in 2 in.) | Rb |
|---|---|---|---|---|---|
| 100 (a) | .131 | 41.2 | 63.0 | 36 | 77 |
| (b) | .131 | 41.1 | 61.0 | 41 | 77 |

The experimental mill heats demonstrate that all of the coils produced in accordance with the invention have not required hot rolled coil grinding, or grinding of the sheet or strip product, for the purpose of improving the surface condition of the open surface defect. Prior to the present invention, Type 409 steel processed for muffler wrap applications resulted in excessive rejections due to open surface defects. The alloy of the present invention has been processed into 20 coils of hot rolled band from 2 mill heats and has not required any corrective grinding of HRB coils for open surface defects and has resulted in improved surface quality.

As was an object of the present invention, a ferritic stainless steel has been provided which can be cold rolled to final gauge having substantially no open surface defects or other melting related defects attributable to titanium precipitates during melting. An embodiment of such a steel has the advantage that it has improved oxidation resistance under both continuous and cyclic conditions as well as improved hot strength. The steel has demonstrated that it is weldable and has good formability and there is reason to believe that the steel will be brazeable. The steel has also exhibited a capability of being high frequency welded. The steel of the present invention can be rolled to thinner gauges on the order of less than 0.015 inch than was commercially feasible on a regular basis with Type 409 steel. The method of the present invention maintains the solubility product of titanium compounds below the saturation levels at the liquidus temperature of the steel melt to avoid precipitates which affect surface appearance. The steel of the present invention can be processed in a less costly manner because the grinding procedures common in the prior art may be eliminated.

Although several embodiments of the present invention have been shown and described, it will be apparent to those skilled in the art that modifications may be made therein without departing from the scope of the invention.

What is claimed is:

1. A weldable ferritic stainless steel sheet or strip having improved surface substantially free of open surface defects and elevated temperature oxidation resistance and strength, the steel consisting essentially of, by weight percent, up to 0.03 carbon, 0.012 up to 0.05 nickel, 10 to 25 chromium, up to 1.0 manganese, up to 0.5 nickel, up to 1.0 silicon, 0.03 to 0.35 titanium, 0.10 to 0.6 niobium, optionally up to 1.2 aluminum, balance essentially iron, the titanium and nitrogen present up to maximum amounts which vary inversely and not more than necessary to satisfy the following Equation 1:

$$6.194 - \frac{16437}{T} - \log \% N + \log \% \text{Ti} + \log + f_N + \log f_{Ti}$$

where log $f_N$ is described in Equation 2 log $f_{Ti}$ is described in Equation 3, the sheet or strip being substantially free of titanium intermetallic and nonmetallic precipitates.

2. The steel of claim 1 wherein the chromium is about 10 to 13.

3. The steel of claim 1 wherein the chromium is about 16 to 19.

4. The steel of claim 1 having a final gauge of 0.015 inch or less.

5. The steel of claim 1 having 0.5 to 0.7 silicon present.

6. The steel of claim 1 further having up to 0.10 aluminum, up to about 0.12 titanium, and up to 0.12 titanium plus aluminum.

7. The steel of claim 1 having up to 0.01 carbon, up to 0.03 nitrogen, less than 0.1 titanium, at least 0.2 niobium, less than 0.1 aluminum, and at least 0.5 silicon.

8. The steel of claim 1 exhibiting improved surface quality substantially free of melting related open surface defects attributable to precipitation of titanium compounds.

9. The steel of claim 1 exhibiting improved resistance to thermal cyclic oxidation.

10. The steel of claim 1 fabricated into a welded article for elevated temperature service.

11. The steel of claim 6 fabricated into a brazed article.

12. An automotive exhaust article for elevated temperature service having improved oxidation resistance and surface quality, the article being made from a steel alloy consisting essentially of, by weight percent, up to 0.01 carbon, up to 0.03 nitrogen, 10 to 25 chromium, up to 1.0 manganese, up to 0.5 nickel, 0.5 to 1.0 silicon, optionally up to 1.2 aluminum, 0.03 to 0.1 titanium, 0.1 to 1.0 niobium, balance essentially iron, and the titanium and nitrogen present in amounts which vary inversely and not more than necessary to satisfy the following Equation 1:

$$6.194 - \frac{16437}{T} - \log \% N + \log \% \text{Ti} + \log f_N + \log f_{Ti}$$

where log $f_N$ is described in Equation 2 and log $f_{Ti}$ is described in Equation 3.

* * * * *

UNITED STATES PATENT AND TRADEMARK OFFICE

CERTIFICATE OF CORRECTION

PATENT NO. : 4,964,926

DATED : October 23, 1990

INVENTOR(S) : James B. Hill

It is certified that error appears in the above-identified patent and that said Letters Patent is hereby corrected as shown below:

In the claims:

In claim 1, lines 8-9, delete "0.012 up to 0.05 nickel" and insert -- 0.012 up to 0.05 nitrogen --

In claims 1 and 12, in Equation 1, before the word "log", delete "-" and insert -- = --.

Signed and Sealed this

Eighteenth Day of August, 1992

*Attest:*

DOUGLAS B. COMER

*Attesting Officer*

*Acting Commissioner of Patents and Trademarks*